United States Patent [19]

Berthelsen

[11] 4,224,868

[45] Sep. 30, 1980

[54] PRESS, ESPECIALLY FOR PRESSING STRAW MATERIAL INTO BRIQUETS

[76] Inventor: Mogens R. Berthelsen, "Rislykke", Vejleby, 4970 Rødby, Denmark

[21] Appl. No.: 929,590

[22] Filed: Jul. 31, 1978

[30] Foreign Application Priority Data

Aug. 4, 1977 [DK] Denmark ..... 3490/77

[51] Int. Cl.[2] ..... B30B 9/30

[52] U.S. Cl. ..... 100/98 A; 100/DIG. 4

[58] Field of Search ..... 100/DIG. 4, DIG. 5, 100/DIG. 6, DIG. 9, 210, 98

[56] References Cited

U.S. PATENT DOCUMENTS

| | | | |
|---|---|---|---|
| 1,804,283 | 5/1931 | Sizer | 100/DIG. 4 |
| 3,063,361 | 11/1962 | Gehrke | 100/DIG. 4 |
| 3,234,894 | 2/1966 | Dechert | 100/DIG. 4 |
| 3,327,653 | 6/1967 | Crane | 100/DIG. 4 |
| 3,490,390 | 1/1970 | Toit | 100/DIG. 4 |

FOREIGN PATENT DOCUMENTS

| | | | |
|---|---|---|---|
| 744384 | 2/1956 | United Kingdom | 100/DIG. 4 |

*Primary Examiner*—Harvey C. Hornsby
*Assistant Examiner*—Arthur O. Henderson
*Attorney, Agent, or Firm*—A. C. Nolte, Jr.; Edward B. Hunter

[57] ABSTRACT

The invention relates to a press, especially for pressing straw material into briquets. The press has a number of press chambers open at either end and a number of pistons, the press chambers and pistons being connected to guiding means and driving means so that the pistons are moved inwards and outwards in relation to the press chambers at one end thereof for introducing press material in portions, pressing the press material and moving it to the other end of the press chambers where it is delivered. The pistons have a smaller outer extent than the inner extent of the press chambers in the engagement region of the pistons. Hereby some advantages are obtained.

10 Claims, 3 Drawing Figures

PRESS, ESPECIALLY FOR PRESSING STRAW MATERIAL INTO BRIQUETS

Figure 1:
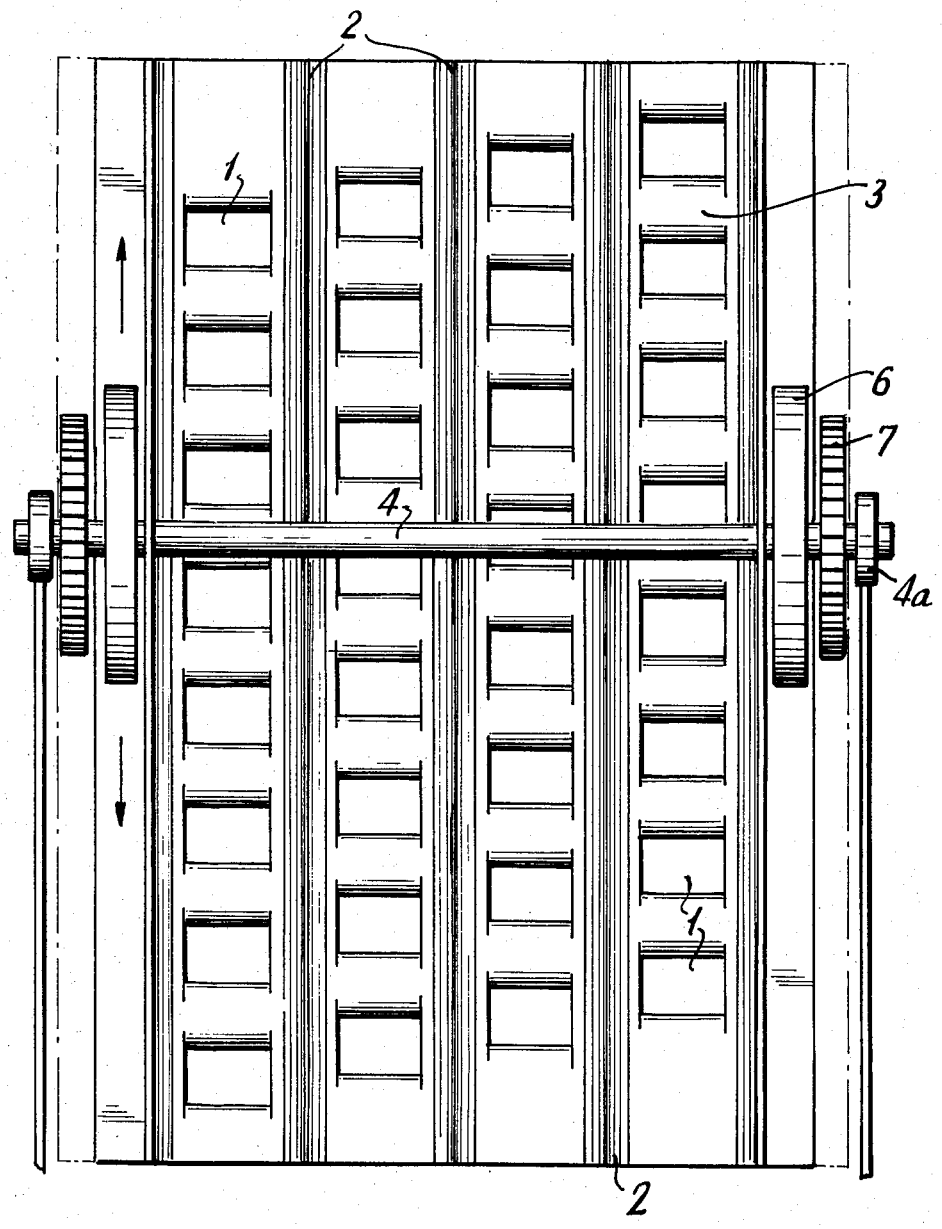

The invention relates to a press having a number of press chambers open at either end and a number of pistons, the press chambers and pistons being connected to guiding means and driving means so that the pistons are moved inwards and outwards in relation to the press chambers at one end thereof for insertion of press material in portions, pressing the press material and moving it to the other end of the press chambers where it is delivered. The press according to the invention is especially intended for pressing straw material.

A press of the said type is known in which the press chambers comprise a tapered introduction part and a press chamber part adjoining the narrowest portion of the introduction part and having its inner extent substantially identical with the inner extent of said narrowest portion of the introduction part. In this known press the pistons are arranged to fill the narrowest portion of the introduction part, and by the movement inwards they will produce a clipping effect on the press material. This known press has a great energy consumption, and great forces are produced so that a strong construction is required. It is only suited for straw material that is finely subdivided. The structure of the straw material is damaged by the pressing.

It is the object of the invention to provide a press of the type stated in which the said drawbacks are completely or partially remedied.

The press according to the invention is characterized in that the pistons have a smaller outer extent than the inner extent of the press chambers in the engagement region of the pistons. Hereby a clipping effect on the press material will not take place. When the press material is strawy and has a suitable length it will bend on the end edge of the pistons and the bent portions will be received in the space between the piston and the wall of the press chamber and will be taken along by the next press movement of the piston. The press has a rather small energy consumption. Great forces are not produced and accordingly a rather light construction can be used. The press is well suited for straw material having relatively great length and the structure of straw material will not be damaged very much.

In a press where the press chambers comprise a tapered introduction part and a press chamber part adjoined to the narrowest portion of the introduction part and having its inner extent nearest the narrowest portion of the introduction part substantially identical with the inner extent of said narrowest portion, the pistons may according to the invention in the engagement position project into said press chamber portion. Hereby the said advantages can be obtained in an especially efficient manner, seeing that the bent strawy material will be received between the piston and the said portion of the press chamber part.

According to the invention the press chambers may be arranged in rows beside each other. Hereby especially long straw pieces can be used as press material, the pieces being torn between the rows of press chambers.

According to the invention the press may be so constructed that the pistons are arms on a turnable shaft and that the guiding means are arranged for giving the arms a rolling movement in relation to the press chambers. Such construction is known per se but it obtains an expecial meaning and importance because the pistons do not fill the press chambers in the engagement region so that the varying angular position of the pistons will have an advantageous effect upon the press function.

In the drawing an embodiment of a press according to the invention is shown.

Figure 2:
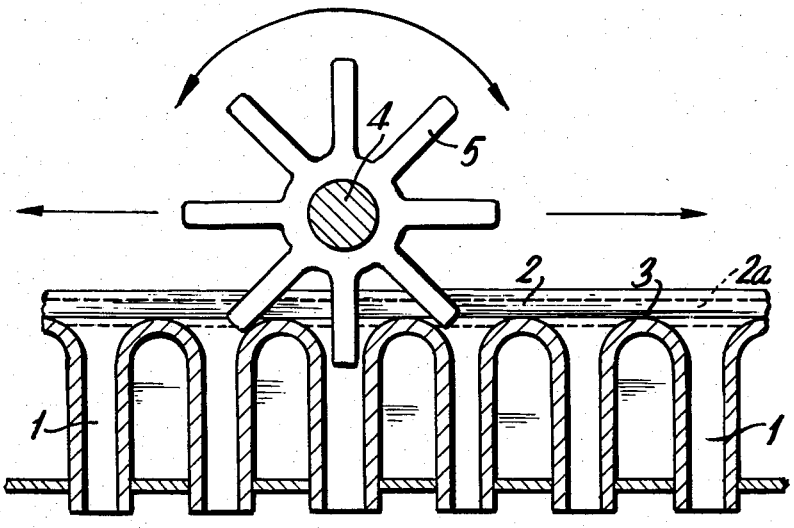

FIG. 1 shows the press in plan view, diagrammatically and some parts left out,

FIG. 2 the same in longitudinal sectional view, and

Figure 3:
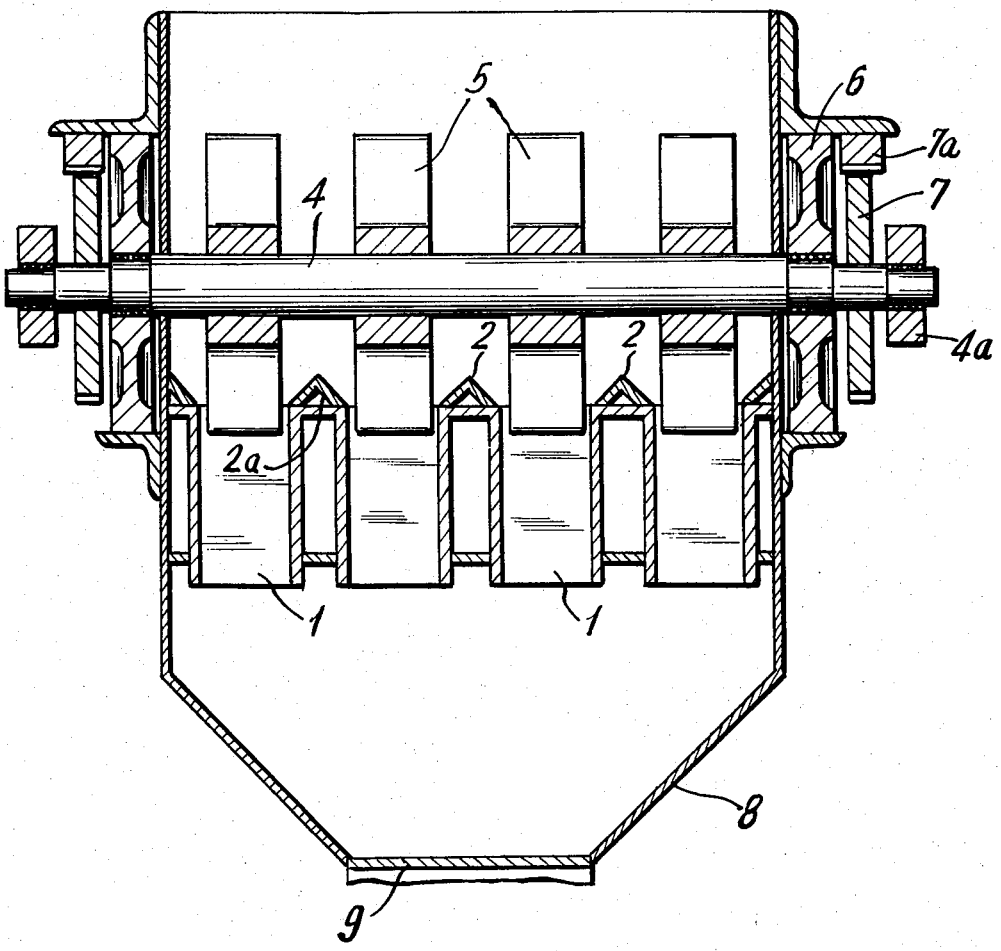

FIG. 3 a cross sectional view in the press.

The press shown in the drawing has a number, in rows arranged, upwards and downwards open press chambers 1, having rectangular cross sectional shape as shown in FIG. 1, in which four parallel rows are shown. The rows of press chambers 1 are at the top separated by means of longitudinally arranged angle irons 2 placed with the corner upwards. In the longitudinal direction of the rows the press chambers are interconnected by means of curved parts 3. The press has a shaft 4 upon which are unturnably arranged wheels with radially projecting arms 5. The shaft 4 is arranged turnable and movable to-and-fro in the longitudinal direction of the rows of press chambers in such a manner that the arms 5 engage into the press chambers 1. The press chambers 1 in the rows are offset in relation to each other in the longitudinal direction of the rows, and the arms 5 are correspondingly offset.

The shaft 4 is horizontally movable, as well as turnable corresponding to the horizontal movement in such a manner that the arms 5 will engage into the press chambers 1. At either end of the shaft a guiding wheel 6 is arranged for guiding the shaft 4 in its horizontal movement and taking up vertical force from the press operation, as well as a gear wheel 7 cooperating with a fixedly positioned toothed rod *7a* for rotation of the shaft corresponding to the movement to-and-fro. The shaft 4 is connected with drive means, not shown, comprising for instance a connecting rod with a bearing 4*a*.

When using the press shown in the drawing straw or the like is supplied, for instance having a length 6-8 cm, preferably with addition of a binding agent, especially a binding liquid which is supplied through the channels formed by the angle irons 2 and a top plate 2*a*, having side apertures through which the binding agent is delivered directly into the press chambers, below the level of the top plate 2*a*. The press material falls down into the press chambers 1 in which it is pressed downwards by the arms 5 by a rolling movement so that briquets are formed which fall out at the lower end of the press chambers in an oblong funnel 8 having at the bottom a longitudinal aperture in which is arranged the upper part 9 of a conveyor band.

The embodiment shown and described is only to be considered as an example, and within the scope of the invention variations are possible. It may be advantageous that each press chamber is operated two or more times of arms 5 acting on two or more places of the press chamber cross section. Hereby it is obtained that the press is subjected to only a small force. Moreover, hereby can be handled relatively long material, for instance 15 cm. The said operation two or more times may be obtained by arranging the toothed rod *7a* movable in longitudinal direction.

The speed of the movement to-and-fro of the shaft 4 and accordingly the rotational speed of the wheels with the arms 5 may advantageously be so high that the wheels with the arms provide a spreading action on the material so that an even filling of the press chambers is obtained. By the movementof the arms downwards air will flow upwards whereby a cooling effect is obtained.

I claim:

1. A press, especially for pressing straw material or the like into briquets while preventing such material from being cut, which comprises a plurality of press chambers of substantially uniform size and shape aligned in a straight line tandem with respect to each other, each of said press chambers comprising an entrance region, an exit, and an intermediate compaction zone for passage of said material therebetween, the widths of said entrance, exit, and intermediate compaction zone being substantially uniform, a number of elongate piston means associated with corresponding ones of said chambers; said piston means each being reciprocable into and from said compaction zone of its associated chamber and having a given compaction face area lesser than the area bound by the marginal edges of said chamber at the entrance region to said compaction zone to define a clearance between the piston means and said edges in that region, said piston means being further characterized in that its terminal portion is narrow enough to pass through said entrance region, exit and intermediate compaction zone of the chamber with which it is associated without contacting the marginal side portions of said chamber, and wide enough to compact said material within said chamber without cutting or severing said material within said chamber.

2. A press as claimed in claim 1 wherein said press chambers are arranged in parallel, side by side rows.

3. A press as claimed in claim 2 wherein said piston means comprise arms projecting from a rotatable shaft, and wherein guide means are provided for supporting said shaft for rolling movement.

4. A press as claimed in claim 3 wherein said piston means associated with one of said rows of press chambers is angularly offset from the piston means associated with others of said rows whereby said piston means project into said compaction zones at intervals.

5. A press as claimed in claim 1 wherein said piston means comprise arms projecting from a rotatable shaft, and wherein guide means are provided for supporting said shaft for rolling movement.

6. A press as claimed in claim 5 wherein said piston means associated with one of said rows of press chambers is angularly offset from the piston means associated with others of said rows whereby said piston means project into said compaction zones at intervals.

7. A press, especially for pressing straw material or the like into briquets while preventing such material from being cut, which comprises a plurality of press chambers of substantially uniform size and shape aligned in a straight line tandem with respect to each other, each of said press chambers comprising a relatively wide portal for receiving such material, an exit for discharging the material from the chamber, and a relatively narrow material-compacting zone communicating with said portal and constructed and arranged to provide a restricted passage for said material from the portal to said exit; a number of elongate piston means associated with corresponding ones of said chambers; said piston means each being reciprocable into and from said compacting zone of its associated chamber and having a given compacting face area less than the area bound by the marginal edges of said chamber at the portal region to said compacting zone to define a clearance between the piston means and said edges in that region, said piston means being further characterized in that its terminal portion is narrow enough to pass through said portal, exit and material-compacting zone of the chamber with which it is associated without contacting the marginal side portions of said chamber, and wide enough to compact said material within said chamber without cutting or severing said material within said chamber.

8. A press as claimed in claim 2 wherein said press chambers are arranged in parallel, side by side rows.

9. A press as claimed in claim 8 wherein said piston means comprise arms projecting from a rotatable shaft, and wherein guide means are provided for supporting said shaft for rolling movement.

10. A press as claimed in claim 9 wherein said piston means associated with one of said rows of press chambers is angularly offset from the piston means associated with others of said rows whereby said piston means project into said compaction zones at intervals.

* * * * *